US007597935B2

(12) United States Patent
Xu et al.

(10) Patent No.: US 7,597,935 B2
(45) Date of Patent: Oct. 6, 2009

(54) PROCESS FOR PREPARING CHROME SURFACE FOR COATING

(75) Inventors: Qihua Xu, Grand Rapids, MI (US); Ling Hao, Grand Rapids, MI (US); Lawrence P. Donovan, III, Lowell, MI (US); Roger J. Timmer, Lowell, MI (US); Lee A. Chase, East Grand Rapids, MI (US); Trevor R. Nicholas, Grand Rapids, MI (US); David P. Hartrick, Lowell, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 1333 days.

(21) Appl. No.: 10/140,230

(22) Filed: May 6, 2002

(65) Prior Publication Data

US 2003/0205481 A1 Nov. 6, 2003

(51) Int. Cl.
*B05D 7/00* (2006.01)
*B05D 3/02* (2006.01)

(52) U.S. Cl. ..... 427/409; 427/327; 427/388.1; 427/407.1; 427/421.1; 427/435

(58) Field of Classification Search ..... 427/409, 427/407.1, 388.1, 327, 421, 435; 205/324, 205/83
See application file for complete search history.

(56) References Cited

U.S. PATENT DOCUMENTS

| | | | | | |
|---|---|---|---|---|---|
| 3,616,394 | A | * | 10/1971 | Koepke et al. | 204/488 |
| 3,801,354 | A | * | 4/1974 | Rist | 428/463 |
| 4,169,770 | A | * | 10/1979 | Cooke et al. | 205/139 |
| 4,315,970 | A | | 2/1982 | McGee | 428/412 |
| 4,364,731 | A | | 12/1982 | Norling et al. | 433/218 |
| 4,391,858 | A | | 7/1983 | Batzill | 427/407.1 |
| 4,539,345 | A | | 9/1985 | Hansen | 523/219 |
| 4,542,070 | A | | 9/1985 | Ohtani et al. | 428/416 |
| 4,620,993 | A | | 11/1986 | Suss et al. | 427/407.1 |
| 4,620,994 | A | | 11/1986 | Suss et al. | 427/407.1 |
| 4,822,631 | A | * | 4/1989 | Beaudet | 427/469 |
| 4,874,643 | A | | 10/1989 | Oldham et al. | 427/340 |
| 4,980,196 | A | | 12/1990 | Yasuda et al. | 427/38 |
| 5,015,506 | A | | 5/1991 | Purcell | 427/333 |
| 5,032,237 | A | * | 7/1991 | Wieserman et al. | 205/188 |
| 5,139,601 | A | | 8/1992 | Holmes-Farley et al. | 156/329 |
| 5,190,795 | A | | 3/1993 | Culler | 427/226 |
| 5,225,248 | A | | 7/1993 | Stephenson | 427/333 |
| 5,238,708 | A | | 8/1993 | Blizzard | 427/322 |
| 5,272,223 | A | | 12/1993 | Iri et al. | 525/452 |
| 5,326,594 | A | | 7/1994 | Sabata et al. | 427/327 |
| 5,389,301 | A | | 2/1995 | Fenzi | 252/394 |
| 5,413,809 | A | | 5/1995 | Hazan | 427/140 |
| 5,429,880 | A | | 7/1995 | Kubota et al. | 428/623 |
| 5,543,262 | A | * | 8/1996 | Sypek et al. | 463/162 |
| 5,547,757 | A | | 8/1996 | Swarup et al. | 428/413 |
| 5,549,932 | A | | 8/1996 | Ishidoya et al. | 427/385.5 |
| 5,578,347 | A | * | 11/1996 | Chan | 427/336 |
| 5,580,819 | A | | 12/1996 | Li et al. | 427/167 |
| 5,753,316 | A | | 5/1998 | Brent et al. | 427/486 |
| 5,807,430 | A | * | 9/1998 | Zheng et al. | 106/287.11 |
| 5,853,808 | A | | 12/1998 | Arkles et al. | 427/377 |
| 5,853,809 | A | | 12/1998 | Campbell et al. | 427/407.1 |
| 5,853,895 | A | | 12/1998 | Lewno | 425/425.6 |
| 5,869,141 | A | | 2/1999 | Blohowiak et al. | 427/309 |
| 5,902,645 | A | | 5/1999 | Vorse et al. | 427/387 |
| 5,910,555 | A | | 6/1999 | Ueda et al. | 528/34 |
| 5,912,052 | A | | 6/1999 | Kuwano et al. | 427/258 |
| 5,932,667 | A | | 8/1999 | Gregorovich et al. | 525/477 |
| 5,965,272 | A | | 10/1999 | Donnelly et al. | 428/447 |
| 5,981,642 | A | | 11/1999 | Overbeek et al. | 524/457 |
| 5,985,370 | A | | 11/1999 | Ohira et al. | 427/387 |
| 6,015,848 | A | | 1/2000 | Ikushima et al. | 523/427 |
| 6,048,579 | A | | 4/2000 | Wang et al. | 427/387 |
| 6,068,719 | A | | 5/2000 | Lewno | 156/108 |
| 6,071,566 | A | | 6/2000 | Brown et al. | 427/387 |
| 6,080,816 | A | | 6/2000 | Gregorovich et al. | 525/100 |
| 6,099,953 | A | | 8/2000 | Komai et al. | 428/312.8 |
| 6,100,367 | A | | 8/2000 | Kobayashi et al. | 528/196 |

(Continued)

FOREIGN PATENT DOCUMENTS

JP 02014188 A * 1/1990

(Continued)

OTHER PUBLICATIONS

"Organofunctional Silane Y-9669 for Adhesives and Sealants Phenylaminosilane Adhesion Promoter"; Witco Corporation, 1998, 6 pages.

*Primary Examiner*—Elena T Lightfoot
(74) *Attorney, Agent, or Firm*—Price, Heneveld, Cooper, Dewitt & Litton, LLP

(57) ABSTRACT

A process for preparing a chrome substrate for application of a polymer coating, wherein the substrate preparation enhances adhesion and durability of the adhesion between the chrome substrate and the polymer coating, involves contacting the chrome substrate with an acid solution for a period of time sufficient to modify the surface of the chrome substrate. In certain embodiments, the acid treatment is an anodic treatment. In accordance with certain aspects of this invention, the acid treated chrome surface is further treated with a silane compound to enhance adhesion with a subsequently applied polymer coating composition.

50 Claims, No Drawings

U.S. PATENT DOCUMENTS

| | | | | |
|---|---|---|---|---|
| 6,103,381 | A | 8/2000 | Mokerji | 428/412 |
| 6,103,387 | A | 8/2000 | Yamamoto et al. | 428/482 |
| 6,162,938 | A | 12/2000 | Hansen et al. | 556/419 |
| 6,187,834 | B1 | 2/2001 | Thayer et al. | 522/15 |
| 6,197,863 | B1 | 3/2001 | Eck et al. | 524/430 |
| 6,225,434 | B1 | 5/2001 | Sadvary et al. | 528/29 |
| 6,268,440 | B1 | 7/2001 | Kudo et al. | 525/477 |
| 6,413,588 | B1 * | 7/2002 | Pettus et al. | 427/327 |
| 6,479,207 | B1 * | 11/2002 | Mori | 430/138 |
| 6,602,741 | B1 * | 8/2003 | Kudoh et al. | 438/141 |

FOREIGN PATENT DOCUMENTS

| | | | |
|---|---|---|---|
| JP | 03267379 | A * | 11/1991 |

* cited by examiner

PROCESS FOR PREPARING CHROME SURFACE FOR COATING

FIELD OF THE INVENTION

This invention relates to a process for preparing a chrome substrate for application of a polymer coating, and more particularly to a process for preparing a chrome substrate to achieve a durable bond between the chrome substrate and a subsequently applied polymer film.

BACKGROUND OF THE INVENTION

Traditional chrome plating creates a smooth, bright chrome finish. It has long been desired to have tinted lustrous metallic finishes, such as black chrome, gold-tinted chrome, and other tinted or colored metallic finishes for decorative purposes. More specifically, there has been a desire for clear polymeric decorative coatings that allow the brightness and luster of chrome plating to be seen, while modifying the appearance by imparting a color or tint to the chrome plating.

Several methods have been used in an attempt to achieve colored metallic finishes. One method involves electroplating, wherein black chrome and bronze finishes can be created. A problem with the electroplating methods is that it is very difficult to consistently obtain a desired colored metallic finish. Another disadvantage with the electroplating techniques is that they are generally limited to black and bronze colors or combinations thereof.

Another method that has been used for obtaining colored metallic finishes involves physical vapor deposition (PVD). This method offers a wider variety of colors than the electroplating method. However, physical vapor deposition is very expensive, and therefore, its use for achieving a desired colored finish is extremely limited. Another problem with physical vapor deposition is that it is difficult to control the gloss of the finishes.

Another method that has been attempted for obtaining colored metallic finishes involves applying transparent organic polymer coating containing a dye, pigment or other colorant on a chrome-plated substrate. This method is convenient, and offers a very wide variety of color finishes. However, the use of organic coatings on chrome-plated substrates has been extremely limited due to poor adhesion between the organic coating and the chrome surface, especially after prolonged exposure to extreme temperature and/or humidity. Even organic polymer coating compositions which initially exhibit good adhesion have not exhibited adequate adhesive durability for most product applications. As a result, this technique has not been applied to automotive components.

A process for adhering a relatively thick layer (e.g., 5 millimeters) of polyurethane elastomer to a metal, such as steel, iron or aluminum, is disclosed in U.S. Pat. No. 4,542,070. The process involves coating the surface of the metal with a primer composition containing a polyepoxy compound and a polyamine compound, further coating the surface with a composition containing an isocyanate compound having an isocyanate group concentration of 15-50% by weight, and casting a layer of polyurethane elastomer onto the double coated surface of the metal followed by hardening the whole system. A silane-coupling agent may be added to the primer composition to improve adhesive properties and water resistance. Disclosed examples of silane-coupling agents include gamma-glycidoxypropyltrimethoxysilane and gamma-aminopropyltriethoxysilane. Color pigments may be added to the composition. Solvents that may be used for the primer composition are those which dissolve both the polyamine compound and the polyepoxy compound, with examples including toluene, xylene, ethylbenzene, methylethylketone, methylcellosolve, ethylcellosolve and acetate esters of a cellosolve compound. The polyurethane elastomer is used to improve the durability of steel, iron and aluminum surfaces of metal articles.

U.S. patent application Ser. No. 09/707,866 describes a process for creating unique surface finishes on chrome-plate substrates. The process provides an economical way of creating surface finishes similar to black chrome, and other colored metallic finishes. The process employs an adhesion enhancer that can be applied as a primer or as an additive to a polyurethane composition. More particularly, in one embodiment, the process includes steps of applying an aqueous primer composition to a chrome substrate, wherein the primer composition containing a silane adhesion promoter; drying the applied primer composition; applying a urethane composition over the chrome plate on which the aqueous primer was applied and dried; and curing the urethane composition to form a polyurethane film. Both the film and the adhesion between the film and chrome plating are durable enough for practical applications such as in the automotive interior industry and in electronic devices such as cellular telephones. However, the processes described in this reference do not consistently provide the required adhesive durability needed for exterior automotive applications. Therefore, a process for forming a polymer film on a metal surface to provide a coating or tinted coating which exhibits consistently improved adhesive durability suitable for exterior automotive applications and other applications in which the coating is subjected to weather or other extreme conditions is desired.

SUMMARY OF THE INVENTION

The invention pertains to a process for preparing a chrome substrate for application of a polymer coating, wherein the substrate preparation consistently enhances adhesion and durability of the adhesion between the chrome substrate and the polymer coating. The improved adhesive durability meets or exceeds criteria for interior and exterior automotive applications. In addition to automotive applications, the processes of this invention may be advantageously employed in other applications in which adhesive durability between a chrome substrate and a polymer coating is desired such as residential building door and cabinet hardware and plumbing.

The process involves contacting the chrome substrate with an acid solution for a period of time sufficient to modify the surface of the chrome substrate whereby improved adhesion and improved adhesive durability are achieved between a polymer coating and the chrome substrate. In certain embodiments, the acid treatment is an anodic treatment.

In accordance with certain aspects of this invention, the acid treated chrome surface is further treated with a silane compound to enhance adhesion with a subsequently applied polymer coating composition.

In accordance with a preferred aspect of the invention, improved adhesion between a chrome substrate and a polymer coating composition is achieved by contacting the chrome substrate with an acid solution for a period of time sufficient to modify the surface of the chrome substrate; treating the chrome substrate with a silane compound to protect the surface from contaminants and/or oxidation during handling, storage, and/or shipment; washing the treated substrate after handling, storage and/or shipment; and treating the washed substrate with a silane compound to enhance adhesion with a subsequently applied polymer coating composition.

These and other features, advantages and objects of the present invention will be further understood and appreciated by those skilled in the art by reference to the following specification and claims.

DESCRIPTION OF THE PREFERRED EMBODIMENTS

The expression "polymer" and derivatives thereof are meant to encompass homopolymers, copolymers, terpolymers, and polymers comprised of four or more monomers. Similarly, the expression "copolymer" and derivatives thereof is meant to encompass polymers that are the reaction product of two or more monomers, including terpolymers and polymers that are the reaction product of four or more monomers. The words "comprising", "including", "containing" and derivatives of these words are not meant to exclude other polymers, ingredients and/or components. Similarly, the articles "a" and "an" are generally meant to mean at least one, and should not be construed to mean only one.

The process of this invention may be used for forming a polymer film coating on generally any metal surface. However, the invention is particularly useful for providing a tenacious, durable adhesive bond between a polymer film coating and a chromium surface. Chrome surfaces have been particularly difficult to coat with a polymeric film that adheres to the surface tenaciously and durably, and in particular it has been difficult to provide a polymeric film coating on chrome surfaces which can withstand extended use in exterior automotive applications, and other hostile or extreme environments. Accordingly, preferred applications for the invention relate to the provision of functional or decorative polymer film coatings on bright chrome surfaces, especially electroplated chrome surfaces.

In each of the embodiments of this invention, a chrome surface, such as an electrodeposited chrome plating or a chrome coating formed by physical vapor deposition, is treated with an acid solution under conditions and for a period of time sufficient to promote excellent adhesion and adhesive durability between the treated chrome surface and a subsequently applied polymer coating. Chromic acid solutions used in the surface treatments of this invention typically contain from about 1 to about 50 ounces of $H_2CrO_4$ per gallon of solution. Other acid solutions that may be used include sulfuric acid solutions.

In accordance with an embodiment of the invention, the chromic acid solution treatment is an electrolytic surface treatment (i.e., anodic treatment) wherein the surface of the chrome is made anodic. The anodic treatment of the chrome substrate may be achieved by immersing the chrome substrate in a chromic acid or other acid (e.g., sulfuric acid) solution and applying an electrical voltage between the chrome substrate and a cathode (e.g., a steel, carbon, graphite, lead, stainless steel, titanium or other insoluble cathode) that is also immersed in the chromic acid solution. Typically, a current density of from about 1 to about 100 amps per square foot may be used during the anodic treatment. In general, higher chromic acid concentrations provide higher electrolyte conductivity whereby a desired anodic treatment may be achieved at a lower DC voltage and/or in less time. In general, concentrations below about 1 ounce of $H_2CrO_4$ per gallon of chromic acid solution are not conducive to achieving the desired surface treatment in a reasonable period of time. However, a concentration of $H_2CrO_4$ in excess of 50 ounces per gallon of chromic acid solution results in relatively uneconomical amounts of $H_2CrO_4$ being carried from the solution and lost when the chrome substrate is removed from the chromic acid solution and rinsed. The chromic acid solution used during anodic treatment is typically maintained at a temperature from about ambient (e.g., 20° C.) to about 95° C. during application of current to the chrome substrate. Depending on conditions used during the anodic treatment (e.g., chromic acid concentration, temperature, current density etc.) a DC current is typically applied for a period of from about 0.5 seconds to about 10 minutes. The DC current may be applied continuously or as a pulsating DC current, or the current may be ramped up. Various other voltage profiles (e.g., voltage versus time) may also be used. Typically, the cathode to anode surface area ratio is from about 1:50 to about 10:1 during the anodic treatment, and more preferably from about 1:5 to about 1:1.

After the anodic treatment, the chrome substrate is removed from the acid solution and rinsed with water. It is desirable that the rinse water is sterile (free of living microorganisms) and relatively free of impurities such as calcium, potassium, silicon and iron salts, etc. Water that is suitable for rinsing the chrome substrate after the chrome substrate has been removed from the acid solution include distilled water, carbon filtered deionized water, carbon filtered reverse osmosis water, boiled deionized water, boiled tap water, ultraviolet light sterilized water, carbonated deionized water, and combinations thereof. Carbon filtered water is water that has been passed through a mass of activated carbon particles that adsorb organic materials. Reverse osmosis water is water that has been purified by applying a pressure to water that is sufficient to overcome the osmotic pressure and cause purified water to flow through a semi-permeable membrane.

In order to further enhance adhesion between the treated chrome surface and a subsequently applied polymer coating composition, a silane adhesion promoter may be applied to the chrome substrate. A silane treatment is highly preferred when a clear coating or a tinted coating is subsequently applied to the chrome surface. Traditionally, it has been especially difficult to achieve good adhesion between a chrome surface and a clear or tinted polymer coating. Opaque coatings containing inorganic pigments generally adhere well to the acid treated (modified) chrome surfaces without a silane treatment. However, even with opaque coatings, a silane treatment may be used to further enhance adhesion between the chrome and the coating. This can be achieved by spraying, dipping, or otherwise suitably contacting the chrome surface with a silane solution containing one or more silane compounds.

Preferred silane compounds include those having two or more hydrolyzable functional groups and at least one functional group selected from vinyl, methacryloxy, epoxy, amino, thiol, polysulfide, ureido and isocyanato. Specific examples of silane compounds that may be utilized to promote adhesion between the treated chrome surface and a subsequently applied polymeric coating include vinyltrimethoxysilane, vinyl-tris-(2-methoxyethoxy)silane, vinylmethyldimethoxysilane, gamma-methacryloxypropyltrimethoxy silane, beta-(3,4-ethoxycyclohexyl) ethyltrimethoxysilane, gamma-glycidoxypropyltrimethoxysilane, gamma-mercaptopropyltrimethoxysilane, bis-(3-[triethoxy silyl]-propyl)-tetrasulfane, gamma-aminopropyltriethoxysilane, gamma-aminopropyltrimethoxysilane, N-beta-(aminoethyl)-gamma-aminopropyltrimethoxysilane, bis-(gamma-trimethoxysilylpropyl)amine, N-phenyl-gamma-aminopropyltrimethoxysilane, N-beta-(aminoethyl)-gamma-aminopropylmethyldimethoxysilane, gamma-ureidopropyltrimethoxysilane, gamma-isocyanatopropyltriethoxysilane, vinyltriacetoxy silane, 3-glycidyloxypropylmethyldiethoxysilane and 3-glycidyloxypropyl-triethoxysilane. Various combinations of silane compounds may also be used. The concentration of the silane compound or compounds in the silane solution is typically from about 0.05% to about 10% by weight of the solution.

An acid may be added to the silane solution to enhance stability and pot life of the silane solution. Desirably, the pH of the silane solution is adjusted from about 3 to about 10, depending on the silane compound or compounds in the solution. For example, a silane solution containing gamma-glycidoxypropyltrimethoxysilane is preferably adjusted to a pH of from about 3.5 to about 4.5. The pH of the silane solution may be adjusted using either an acid or base, depending on the starting pH and the desired final pH. Examples of suitable inorganic acids include hydrofluoric acid, hydrochloric acid, hydrobromic acid, sulfuric acid, phosphoric acid, nitric acid, Lewis acids and combinations of two or more of these acids. Examples of suitable organic acids include acetic acid, maleic acid, succinic acid, mandelic acid, fumaric acid, malonic acid, pyruvic acid, oxalic acid, glycolic acid, salicylic acid, a pyranosidyl acid, an alpha-hydroxy acid, an amino acid, an aromatic acid, a sulfonic acid, acrylic acid, methacrylic acid, polyacrylic acid, polymethacrylic acid, lactic acid, and a combination of two or more of these acids. Combinations of organic and inorganic acids may also be used. Examples of bases include alkali metal hydroxides such as sodium hydroxide and potassium hydroxide. Contacting of the treated chrome surface with the silane solution is normally conducted at ambient temperature (e.g., typically from about 15° C. to about 25 or 30° C.). A suitable contact time between the treated chrome surface and the silane solution is from about 1 second to about 30 minutes.

After contact between the treated chrome substrate and the silane, the chrome substrate is dried. This can be achieved by simply allowing the chrome substrate to air dry under ambient conditions. Alternatively, the chrome substrate may be dried with heated air and/or forced convection, e.g., by causing heated air to flow over or around the chrome substrate. Depending on the conditions that are utilized, drying will typically be achieved in a period of from about 5 seconds to about 2 hours.

The polymer coating composition contains at least one film-forming polymer or prepolymer. Film-forming polymers and/or prepolymers include those polymers that are normally regarded as film-forming polymers in paints and other coating compositions. Alternatively, film-forming polymers are those polymers which are capable of curing (crosslinking) and/or coalescing upon application to a substrate to form a continuous layer of material that is highly impermeable to liquids, especially water.

Examples of suitable compatible, film-forming polymers include generally any polymer useful in coating compositions, including acrylic addition polymers of one or more allyl esters of acrylic acid or methacrylic acid monomers, optionally copolymerized with one or more other ethylenically unsaturated monomers (e.g., vinyl monomers, allylic monomers, acrylic monomers, and the like). Other suitable film-forming polymers include urethane resins, melamine resins, polyester resins, epoxy resins, alkyd resins, and combinations of these resins, as well as various hydroxyl, carboxyl, styrene and/or vinyl modified resins. The film-forming polymers may be curable compositions, i.e., thermosettable compositions, or thermoplastic compositions, e.g., lacquers. Examples of film-forming prepolymers include one and two part compositions that contain polyols and polyisocyanates that react in situ to form polyurethanes, one and two part compositions, containing polyamines and polyisocyanates that react to form polyureas, and the like.

The polymer coating composition may be applied as a liquid or as a powder (i.e., a powder coating composition). The polymer coating composition may also be applied using electrophoretic deposition techniques.

The coating composition may be a clear coating composition, a tinted coating composition, or an opaque coating composition. However, as the invention is primarily directed to the application of decorative coating compositions to bright, lustrous chrome surfaces in which the entire or at least a portion of the chrome surface is seen through the coating, opaque coating compositions are preferably used for selectively applying a patterned coating to a chrome surface to create interesting and appealing decorative effects. Tinted coatings may be used for allowing the bright, lustrous chrome surface to be seen through the coating, while imparting a color or tint to the chrome surface. In addition to decorative applications, the coating compositions and processes of this invention may be used for providing functional coatings, such as protective scratch-resistant coatings, to chrome surfaces.

The coating compositions may contain a silane compound to provide enhanced adhesion between the substrate and the coating.

In accordance with another embodiment of the invention, the chromic acid solution treatment is a hot chromic acid treatment wherein the chrome substrate is contacted with a chromic acid solution that is maintained at a temperature of from about 60° C. to about 95° C. As with the chromic acid solution used for anodic treatment, the solution for the hot chromic acid treatment contains $H_2CrO_4$ in an amount of from about 1 to about 50 ounces per gallon. Contacting of the chrome substrate with a chromic acid solution may be achieved such as by immersing the chrome substrate in a hot chromic acid solution or by spraying a hot chromic acid solution on the chrome substrate. Thereafter, the chrome substrate is rinsed with water, dried and coated with a polymer composition as previously described. A silane treatment may be employed, preferably after the rinsing step. The anodic treatment is suitable for preparing either freshly plated substrates (i.e., those that are still wet after being removed from an electroplating bath), chrome electroplated substrates that have been allowed to dry, or substrates that have been freshly chrome plated using a physical vapor deposition technique; whereas the hot chromic acid treatment (without electrolytic treatment) is better suited for freshly plated substrates (i.e., those that are still wet after removal from the electroplating bath) than for chrome substrates that have been dried.

For either of the processes described above, it may be desirable to contact the chrome substrate with an acid solution (either anodic treatment or hot chromic acid treatment) at one time or at one location, and complete the coating process at a different time and/or at a different location, with intervening handling (e.g., part racking and unracking), packing and/or storage of the chrome substrates. For example, it is contemplated that chrome electroplating on a substrate (either a metal or plastic substrate) may be performed at one facility, and that the plated parts will be packaged and transported to a different facility, for application of a polymer coating composition. The plated parts must be handled during unracking, packaging, shipping, unpackaging, and re-racking for application of the coating. During handling, the chrome surfaces of the parts can become contaminated with fingerprints, packaging materials, spills, and/or airborne contaminants. These contaminants on the chrome surfaces can interfere with good adhesion between the chrome surface and the coating. In such cases, it is desirable to protect the chrome surface with a first silane treatment which is believed to provide a barrier against aging and/or contamination.

Prior to application of another silane treatment which is believed to promote adhesion with a subsequently applied polymer coating composition, it is desirable to reactivate the chrome surface. Such reactivation involves contacting the chrome substrate with a cleaning solution suitable for removing contaminants from metal surfaces. Suitable cleaning solutions include those that are commonly referred to as degreasing solutions. These solutions are typically heated for use and are often alkali solutions. However, suitable neutral and weakly acidic cleaning solutions are also commercially available. Suitable cleaning solutions contain one or more surfactants, and typically contain one or more inorganic builders such as alkali metal silicates, alkali metal borates, alkali metal carbonates, alkali metal polyphosphates, alkali metal phosphates, alkali metal orthophosphates, and/or alkali metal pyrophosphates. Examples of commercially available cleaning solutions that may be utilized include Polyprep® Cleaner 2202, Polyprep® Cleaner 2595 and Prep-N-Cote® 2557L from Henkel Corporation and Gardoclean S5206 available from Chemetall Oakite Company. Reactivation may be achieved by contacting a substrate with a suitable cleaning solution such as by dipping the chrome substrate in the cleaning solution or spraying the cleaning solution onto the chrome substrate. Pressurized wash sprays (i.e., power washing) are preferred. Contacting of the chrome substrate with a cleaning solution may be accompanied with agitation and/or use of ultrasonic energy. Typically, the cleaning solution is heated, such as to a temperature of from about 37° C. to about 75° C. Typical cleansing treatment time (i.e., the duration of contact of the chrome substrate with the cleaning solution) is from about 20 seconds to about 30 minutes. Thereafter, the substrate is preferably contacted with a silane compound to enhance adhesion with a subsequently applied polymer coating.

A washing step as described above is generally desirable whenever a chrome substrate is contacted with contaminants prior to application of a polymer coating. Washing will generally be required whenever unracking and re-racking of parts is performed. Accordingly, most processes in which a substrate is electroplated with chrome and subsequently coated with a polymer composition will require washing due to handling when the parts are removed from an electroplating rack and mounted on a spray painting rack. An example of a process which does not require handling, and therefore does not require washing, is a process in which chrome electroplated parts are treated in accordance with this invention (acid treatment and silane treatment of the surface) and subsequently electrophoretically coated using the same rack used for electroplating. It is also possible to avoid handling in a process in which physical vapor deposition is used to chrome coat a part that is subsequently treated in accordance with the invention in an acid bath, optionally with a silane treatment, and spray coated.

In general, it has been recognized that it is more difficult to achieve satisfactory adhesion between a chrome substrate and a clear polymeric coating than between a chrome substrate and an opaque coating. More specifically, there is a recognized need for a method for applying a clear polymeric coating to a chrome substrate that passes the thermal shock test and water immersion test outlined below. The methods of this invention achieve improved adhesion between a chrome substrate and various polymeric coating compositions, including clear coating compositions, tinted coating compositions, and pigmented (opaque) coating compositions, wherein the resulting coatings pass the thermal shock and water immersion tests. Parts coated in accordance with the methods of this invention are suitable for a variety of applications, including automotive interior and exterior applications.

The following examples demonstrate that the processes of this invention are useful for achieving outstanding adhesion and adhesive durability between a chrome surface and a polymer coating. In the following examples, the thermal shock test involves immersing coated chrome substrates into a water tank for four hours at 38° C.+/−2° C. while aerating the water; removing the samples from the water and cutting an "X" through the coating into the substrate; placing the test samples in the freezer at minus 29° C.+/−2° C. for a three hour minimum freeze cycle; within 30 seconds from freezer removal, directing a steam blast at the center of the "X" cut, at a distance of 2 to 3 inches and 45 degrees to the sample; and determining the area of coating removal. A pass indicates that substantially no coating was removed by the steam blast. The water immersion test involves immersing coated substrates in a water bath maintained at a temperature of 38° C.+/−2° C. for 240 hours; removing the parts from the water and wiping the surfaces thereof dry; cutting a cross-hatch pattern into the coating; pressing a specified adhesive tape on the cut area and pulling at a 90 degree angle quickly; and evaluating coating removal. A "pass" indicates that substantially none of the coating squares defined by the cross-hatch pattern were removed by the tape.

EXAMPLE 1

A silane solution was prepared as following: in a clean glass beaker, 3750 ml distilled water at room temperature was added. 9.5 gram of polyacrylic acid (35 wt. % solution in water, with average $M_w$ ca. of 100,000 from Aldrich, Milwaukee, Wis.) was added and stirred for 10 minutes. 19 gram of gamma-glycidoxypropyltrimethoxysilane (A-187 from OSI Specialties, Inc. Endicott, N.Y.; or A-6040 from Dow Corning Corporation, Midland, Mich.) was then added slowly while stirring. The solution was stirred continuously for two hours and conditioned at ambient for at least 4 hours before use. Fresh chrome plating parts after DI water rinses were immersed in 100 g/L $CrO_3$ at 180° F. for 60 seconds, then rinsed in deionized and distilled water (DDW), and dipped in the above silane solution for 30 seconds. The parts were spray coated with a two-component urethane composition (201SL 18017 from Red Spot Paint & Varnish Co., Inc., Evansville, Ind.) after drying and baked for 60 minutes at 180° F. The parts consistently passed both thermal shock and water immersion tests.

EXAMPLE 2

Dry chrome-plated parts were anodically treated in 85 g/L $CrO_3$ at 135° F. and 80 A/ft$^2$ for 10 seconds, rinsed in deionized and distilled water (DDW), then dipped in the 0.5% silane solution (gamma-glycidoxypropyltrimethoxysilane) of Example 1 at pH of about 3-4 and ambient temperature for 30 seconds, and spray coated with a two-component urethane composition after drying, and baked for 60 minutes at 180° F. The parts consistently passed both the thermal shock and water immersion tests.

EXAMPLE 3

Dry chrome-plated parts were anodically treated in 50 g/L $CrO_3$ at 75° F. and 10 A/ft$^2$ for 60 seconds, rinsed in the reverse osmosis (RO) water purified by activated carbon, then dipped in a 0.5% silane solution (gamma-glycidoxypropyltrimethoxysilane) of Example 1 at pH of about 3-4 and ambient temperature for 30 seconds, and painted (spray coated) with a two-component urethane composition after drying, and baked for 60 minutes at 180° F. The parts consistently passed both the thermal shock and water immersion tests.

EXAMPLE 4

A silane solution was prepared as following: in a clean glass beaker, 3000 ml distilled water at room temperature was added. 7.5 gram of acetic acid and 5.5 gram of polyacrylic acid (35 wt. % solution in water, with average $M_w$ ca. of 100,000 from Aldrich, Milwaukee, Wis.) was added and stirred for 10 minutes. 15 gram of gamma-methacryloxypropyltrimethoxysilane (A-174 from OSI Specialties, Inc., Endicott, N.Y.) was then added slowly while stirring. The solution was stirred continuously for two hours and conditioned at ambient for at least 4 hours before use. Fresh chrome-plated parts were immersed in 100 g/L $CrO_3$ at 180° F. for 60 seconds, rinsed, then dipped in the silane solution of this Example, and coated with a two-component urethane and dried as in Example 1. The parts consistently passed both the thermal shock and water immersion tests.

EXAMPLE 5

A silane solution was prepared as following: in a clean glass beaker, 3000 ml distilled water at room temperature was added. 7.5 gram of acetic acid and 5.5 gram of polyacrylic acid (35 wt. % solution in water, with average $M_w$ ca. of 100,000 from Aldrich, Milwaukee, Wis.) was added and stirred for 10 minutes. 15 gram of vinyltrimethoxysilane (A-171 form OSI Specialties, Inc., Endicott, N.Y.; or Dynasylan VTMO from Degussa Corporation, Parsippany, N.J.) was then added slowly while stirring. The solution was stirred continuously for two hours and conditioned at ambient for at least 4 hours before use. Dry chrome-plated parts were then anodically treated as in Example 2, rinsed, dipped in the silane solution of this Example, and spray coated as in Example 2. The parts consistently passed both the thermal shock and water immersion tests.

EXAMPLE 6

A silane solution was prepared as following: in a clean glass beaker, 3750 ml distilled water at room temperature was added. 9.5 gram of polyacrylic acid (35 wt. % solution in water, with average $M_w$ ca. of 100,000 from Aldrich, Milwaukee, Wis.) was added and stirred for 10 minutes. 19 gram of gamma-glycidoxypropyltrimethoxysilane (such as A-187 from OSI Specialties, Inc. Endicott, N.Y.; or A-6040 from Dow Corning Corporation, Midland, Mich.) was then added slowly while stirring. The solution was stirred continuously for two hours and conditioned at ambient for at least 4 hours before use. Dry chrome-plated parts were anodically treated as in Example 3, rinsed and dipped in the silane solution of this Example. After drying the parts were spray coated with a two-component polyurethane clearcoat (TKU2000C from PPG, Pittsburg, Pa.). The parts consistently passed both the thermal shock and water immersion tests.

EXAMPLE 7

Dry chrome-plated parts were anodically treated in 2% by volume $H_2SO_4$ at 75° F. and 10 A/ft$^2$ for 60 seconds, rinsed in deionized water and distilled water (DDW), then dipped in the 0.5% silane solution (gamma-glycidoxypropyltrimethoxysilane) of Example 1 at pH of about 3 to 4 and ambient temperature for 30 seconds, and painted after drying and baked for 60 minutes at 180° F. The parts consistently passed both the thermal shock and water immersion tests.

EXAMPLE 8

Dry chrome-plated parts were anodically treated in 85 g/L $CrO_3$ at 135° F. and 80 A/ft$^2$ for 10 seconds, rinsed in deionized and distilled water (DDW). To a coating system (201SL 18017 from Red Spot Paint & Varnish Co., Inc.), the 0.5% silane solution (gamma-glycidoxypropyltrimethoxysilane) of Example 1 was added. The parts were painted after drying and baked for 60 minutes at 180° F. The coated parts passed both the thermal shock and water immersion tests.

EXAMPLE 9

Dry chrome-plated parts were anodically treated in 85 g/L $CrO_3$ at 135° F. and 80 A/ft$^2$ for 10 seconds, rinsed in deionized and distilled water (DDW). The parts were coated with a silicone-acrylic coating composition (Origi-ZuG #100 from Origin Electric Co., Ltd.) after drying and baked for 60 minutes at 180° F. The parts were tested as described above and passed.

EXAMPLE 10

Dry chrome-plated parts were anodically treated in 85 g/L $CrO_3$ at 135° F. and 80 A/ft$^2$ for 10 seconds, rinsed in deionized and distilled water (DDW). Then dipped in the 0.5% silane solution (gamma-glycidoxypropyltrimethoxysilane) of Example 1 at pH of about 3-4 and ambient temperature for 30 seconds. The surface is dried at ambient, or with forced air or heated air. The dry time can be from 1 minute to 2 hours. The surface is then dipped in an electrophoretic coating tank and e-coated with a transparent layer at a temperature range of 70° F. to 100° F. using a voltage from 50 V to 100 V. The resulting electrophoretic coating thickness ranges from 0.2 mil to 1 mil. The electrophoretic coat is then dried at from ambient up to 150° F. for 2 to 60 minutes before it is baked at 170° F. to 230° F. for 20 to 60 minutes. The parts passed both the water immersion and thermal shock tests.

EXAMPLE 11

Old chrome-plated parts, which surfaces were contaminated by fingerprints and chemical fumes from plating environment, were first cleaned in an alkaline cleaner to remove surface contamination, thoroughly rinsed in tap water, then anodically treated in a 100 g/L $CrO_3$ solution at ambient temperature and 10 A/ft$^2$ for 60 seconds, rinsed in deionized water with carbon filtration, immersed in the 0.5% silane solution (3-glycidoxypropyltrimethoxysilane) of Example 1 at pH of about 3-4 and ambient temperature for 30 seconds, and painted after drying, and baked for 60 minutes at 165° F. The parts passed both the thermal shock and water immersion tests.

EXAMPLE 12

Fresh dry chrome-plated parts were first anodically treated in a 65 g/L $CrO_3$ solution at ambient temperature and 10 A/ft$^2$ for 60 seconds, rinsed in deionized water with carbon filtration, immersed in the 0.5% silane solution (gamma-glycidoxypropyltrimethoxysilane) of Example 1 at pH of about 3-4 and ambient temperature for 30 seconds, naturally dried and exposed to the plating production environment for 10 days. The surface modified chrome-plated parts with contamination were then shipped to a painting facility. In the painting facility the parts were cleaned in a commercial cleaner (5% Polyprep Cleaner 2202) at 140° F. for 60 seconds, thoroughly rinsed in deionized water with carbon filtration, sprayed with a 0.5% silane solution (gamma-glycidoxypropyltrimethoxysilane) at ambient temperature and pH 4.0 for 30 seconds, dried in an oven at 140° F. for 30 minutes, painted with Red Spot black tinted basecoat and clear topcoat, baked at 165° F. for 60 minutes. The parts passed both the thermal shock and water immersion tests.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A process for depositing a polymer coating on a chrome substrate, comprising:

immersing the chrome substrate in an acid solution;

applying a DC current to the chrome substrate while the chrome substrate is immersed in the acid solution, and selecting an electrical potential whereby the chrome substrate is made anodic while immersed in the acid solution, the application of the DC current being conducted under conditions sufficient to prevent formation of chromium oxide or chromium hydroxide at the surface of the substrate and to cause dissolution of chromium ions from the surface;

removing the chrome substrate from the acid solution, and rinsing the chrome substrate with water;

contacting the rinsed chrome substrate with a silane solution;

drying the chrome substrate after contacting the chrome substrate with the silane solution; and applying a polymer coating to the dried chrome substrate.

2. A process for depositing a polymer coating on a chrome substrate, comprising:

immersing the chrome substrate in a chromic acid solution that contains from about 1 to about 50 ounces of $H_2CrO_4$ per gallon;

applying a DC current to the chrome substrate while the chrome substrate is immersed in the acid solution, and selecting an electrical potential whereby the chrome substrate is made anodic while immersed in the chromic acid solution;

removing the chrome substrate from the chromic acid solution, and rinsing the chrome substrate with water;

contacting the rinsed chrome substrate with a silane solution;

drying the chrome substrate after contacting the chrome substrate with the silane solution; and applying a polymer coating to the dried chrome substrate.

3. A process for depositing a polymer coating on a chrome substrate, comprising:

immersing the chrome substrate in a sulfuric acid solution that contains from about 1 to about 20% of $H_2SO_4$;

applying a DC current to the chrome substrate while the chrome substrate is immersed in the sulfuric acid solution, and selecting an electrical potential whereby the chrome substrate is made anodic while immersed in the sulfuric acid solution;

removing the substrate from the sulfuric acid solution, and rinsing the chrome substrate with water;

contacting the rinsed chrome substrate with a silane solution;

drying the chrome substrate after contacting the chrome substrate with the silane solution; and applying a polymer coating to the dried chrome substrate.

4. The process of claim 1, wherein the acid solution is maintained at a temperature of from about 20° C. to about 95° C. during application of current to the chrome substrate.

5. The process of claim 1, wherein the DC current is applied for a period of at least about 0.5 seconds.

6. The process of claim 1, wherein the current density on the substrate is at least about 1 amp per square foot during application of the DC current.

7. The process of claim 1, wherein the current density on the chrome substrate is from about 1 to about 100 amps per square foot during application of the DC current.

8. The process of claim 1, wherein a cathode to anode ratio of from about 1:50 to about 10:1 is used during application of the DC current to the chrome substrate.

9. The process of claim 1, wherein the water used to rinse the chrome substrate after the chrome substrate has been removed from the acid solution is selected from the group consisting of distilled water, carbon filtered deionized water, carbon filtered reverse osmosis water, boiled deionized water, boiled tap water, ultraviolet sterilized water, and carbonated deionized water.

10. The process of claim 1, wherein the silane solution comprises a silane compound at a concentration of at least about 0.05% by weight.

11. The process of claim 1, wherein the silane solution comprises a silane compound at a concentration of from about 0.05% to about 10% by weight.

12. The process of claim 10, wherein the silane solution is adjusted to a pH that promotes stability of the silane solution.

13. The process of claim 12, wherein the pH is adjusted with an organic acid.

14. The process of claim 13, wherein the organic acid is selected from the group consisting of acetic acid, maleic acid, succinic acid, mandelic acid, fumaric acid, malonic acid, pyruvic acid, oxalic acid, glycolic acid, salicylic acid, a pyranosidyl acid, an alpha-hydroxy acid, an amino acid, an aromatic acid, a sulfonic acid, acrylic acid, methacrylic acid, polyacrylic acid, polymethacrylic acid, lactic acid, and a combination of two or more of these acids.

15. The process of claim 12, wherein the pH is adjusted with an inorganic acid.

16. The process of claim 12, wherein the pH of the solution is adjusted with a base.

17. The process of claim 1, wherein the rinsed substrate is contacted with the silane solution by spraying the silane solution on the rinsed chrome substrate.

18. The process of claim 1, wherein the rinsed chrome substrate is contacted with the silane solution by immersing the rinsed chrome substrate in the silane solution.

19. The process of claim 1, wherein the rinsed chrome substrate is contacted with the silane solution by spraying the chrome substrate with the silane solution.

20. The process of claim 18, wherein the chrome substrate is immersed in the silane solution for a period of at least about 1 second.

21. The process of claim 1, wherein the chrome substrate is dried after being contacted with the silane solution by causing heated air to flow around the chrome substrate.

22. The process of claim 1, wherein the dried chrome substrate is coated with a polymer composition selected from the group consisting of one part curable compositions that form a thermoset film coating upon curing, two part curable compositions that form a thermoset film upon curing, solvent based compositions that contains a solubilized polymer that coalesces to form a thermoplastic film coating upon evaporation of the solvent, and electrophoretic coating compositions.

23. The process of claim 1, wherein the dried chrome substrate is coated with a polymer composition containing a film-forming polymer selected from the group consisting of acrylic addition polymers, urethane resins, polyesters resins, epoxy resins, alkyd resins, and combinations of these resins.

24. The process of claim 1, wherein the silane solution contains one or more silane compounds having two or more hydrolyzable functional groups and at least one functional group selected from vinyl, methacryloxy, epoxy, amino, thiol, polysulfide, ureido and isocyanato.

25. The process of claim 1, wherein the silane solution contains one or more silane compounds selected from the group consisting of vinyltrimethoxysilane, vinyl-tris-(2-methoxyethoxy)silane, vinylmethyldimethoxysilane, gamma-methacryloxypropyltrimethoxy silane, beta-(3,4-ethoxycyclohexyl)ethyltrimethoxysilane, gamma-glycidoxypropyltrimethoxysilane, gamma-mercaptopropyltrimethoxysilane, bis-(3-[triethoxysilyl]-propyl)-tetrasulfane, gamma-aminopropyltriethoxysilane, gamma-aminopropyltrimethoxysilane, N-beta-(aminoethyl)-gamma-aminopropyltrimethoxysilane, bis-(gamma-trimethoxysilylpropyl) amine, N-phenyl-gamma-aminopropyltrimethoxysilane, N-beta-(aminoethyl)-gamma-aminopropylmethyldimethoxysilane, gamma-ureidopropyltrimethoxysilane, gamma-isocyanatopropyltriethoxysilane, vinyltriacetoxy silane, 3-glycidyloxypropylmethyldiethoxysilane and 3-glycidyloxypropyl-triethoxysilane.

26. The process of claim 1, wherein the coating contains a silane compound.

27. The process of claim 1, wherein the coating is an electrophoretic coating.

28. A process for depositing a polymer coating on a chrome substrate, comprising:

contacting the chrome substrate with a chromic acid solution, the chromic acid solution being at a temperature of from about 60° C. to about 95° C.;

terminating contact between the chrome substrate and the chromic acid solution, and rinsing the chrome substrate with water;

contacting the rinsed chrome substrate with a silane solution;

drying the chrome substrate after contacting the chrome substrate with the silane solution; and applying a polymer coating to the dried chrome substrate.

29. The process of claim 28, wherein the chromic acid solution contains from about 1 to about 50 ounces of $H_2CrO_4$ per gallon.

30. The process of claim 25, wherein the water used to rinse the substrate after the plated substrate has been removed from the chromic acid solution is selected from the group consisting of distilled water, carbon filtered deionized water, carbon filtered reverse osmosis water, boiled deionized water, boiled tap water, ultraviolet sterilized water, and carbonated deionized water.

31. The process of claim 20, wherein the silane solution comprises a silane compound at a concentration of at least about 0.05% by weight.

32. The process of claim 28, wherein the silane solution comprises a silane compound at a concentration of from about 0.05% to about 10% by weight.

33. The process of claim 32, wherein the silane solution is adjusted to a pH that promotes stability of the silane solution.

34. The process of claim 33, wherein the pH is adjusted with an organic acid.

35. The process of claim 34, wherein the organic acid is selected from the group consisting of acetic acid, maleic acid, succinic acid, mandelic acid, fumaric acid, malonic acid, pyruvic acid, oxalic acid, glycolic acid, salicylic acid, a pyranosidyl acid, an alpha-hydroxy acid, an amino acid, an aromatic acid, a sulfonic acid, acrylic acid, methacrylic acid, polyacrylic acid, polymethacrylic acid, lactic acid, and a combination of two or more of these acids.

36. The process of claim 33, wherein the pH is adjusted with an inorganic acid.

37. The process of claim 36, wherein the pH is adjusted with a base.

38. The process of claim 28, wherein the rinsed chrome substrate is contacted with the silane solution by spraying the silane solution on the rinsed chrome substrate.

39. The process of claim 28, wherein the rinsed chrome substrate is contacted with the silane solution by immersing the rinsed chrome substrate in the silane solution.

40. The process of claim 39, wherein the chrome substrate is immersed in the silane solution for a period of at least 1 second.

41. The process of claim 28, wherein the chrome substrate is dried after being contacted with the silane solution by causing heated air to flow around the chrome substrate.

42. The process of claim 28, wherein the polymer coating is selected from one part curable compositions that form a thermoset film coating upon curing, two part curable compositions that form a thermoset film upon curing, solvent-based compositions that contain a solubilized polymer that coalesces to form a thermoplastic film coating upon evaporation of the solvent, and electrophoretic coating compositions.

43. The process of claim 28, wherein the dried chrome substrate is coated with a polymer composition containing a film-forming polymer selected from the group consisting of acrylic addition polymers, urethane resins, polyesters resins, epoxy resins, alkyd resins, and combinations of these resins.

44. The process of claim 28, wherein the silane solution contains one or more silane compounds having two or more hydrolyzable functional groups and at least one functional group selected from vinyl, methacryloxy, epoxy, amino, thiol, polysulfide, ureido and isocyanato.

45. The process of claim 28, wherein the silane solution contains one or more silane compounds selected from the group consisting of vinyltrimethoxysilane, vinyl-tris-(2-methoxyethoxy)silane, vinylmethyldimethoxysilane, gamma-methacryloxypropyltrimethoxysilane, beta-(3,4-ethoxycyclohexyl)ethyltrimethoxysilane, gamma-glycidoxypropyltrimethoxysilane, gamma-mercaptopropyltrimethoxysilane, bis-(3-[triethoxysilyl]-propyl)-tetrasulfane, gamma-aminopropyltriethoxysilane, gamma-aminopropyltrimethoxysilane, N-beta-(aminoethyl)-gamma-aminopropyltrimethoxysilane, bis-(gamma-trimethoxysilylpropyl) amine, N-phenyl-gamma-aminopropyltrimethoxysilane, N-beta-(aminoethyl)-gamma-aminopropylmethyldimethoxysilane, gamma-ureidopropyltrimethoxysilane, gamma-isocyanatopropyltriethoxysilane, vinyltriacetoxy silane, 3-glycidyloxypropylmethyldiethoxy-silane and 3-glycidyloxypropyl-triethoxysilane.

46. The process of claim 29, wherein the chrome substrate is contacted with the chromic acid solution by immersing the chrome substrate in the chromic acid solution.

47. The process of claim 29, wherein the chrome substrate is contacted with the chromic acid solution by spraying the chromic acid solution on the chrome substrate.

48. The process of claim 29, wherein the chrome substrate is contacted with the chromic acid solution for a period of from about 10 seconds to about 30 minutes.

49. The process of claim 28, wherein the coating contains a silane compound.

50. The process of claim 28, wherein the coating is an electrophoretic coating.

* * * * *